United States Patent [19]

Bergeron

[11] Patent Number: 5,029,923

[45] Date of Patent: Jul. 9, 1991

[54] POWER BUCKET

[76] Inventor: Raymond Bergeron, 3452 W. Jefferson, Trenton, Mich. 48183

[21] Appl. No.: 412,918

[22] Filed: Sep. 26, 1989

Related U.S. Application Data

[63] Continuation-in-part of Ser. No. 341,488, Apr. 20, 1989, abandoned.

[51] Int. Cl.[5] ..... B66C 3/02

[52] U.S. Cl. ..... 294/68.23; 294/111; 37/184

[58] Field of Search ..... 294/68.23, 68.1, 68.2, 294/68.21, 68.22, 111, 112, 66.1; 37/183 R, 184

[56] References Cited

U.S. PATENT DOCUMENTS

| | | | |
|---|---|---|---|
| 1,444,800 | 2/1923 | Mellin | 37/184 |
| 2,049,679 | 8/1936 | Whiteman et al. | 294/111 X |
| 4,143,901 | 3/1979 | van Huuksloot | 294/68.23 |
| 4,327,943 | 5/1982 | Longo | 294/68.23 |
| 4,538,848 | 9/1985 | Aberkrom | 294/111 X |

FOREIGN PATENT DOCUMENTS

| | | | |
|---|---|---|---|
| 1353008 | 1/1964 | France | 294/68.23 |
| 1364596 | 1/1988 | U.S.S.R. | 294/111 |

*Primary Examiner*—Margaret A. Focarino
*Assistant Examiner*—Dean J. Kramer
*Attorney, Agent, or Firm*—Gifford, Groh, Sprinkle, Patmore and Anderson

[57] ABSTRACT

A bucket for a power shovel is disclosed which includes a first and second bucket half. Each bucket half includes a pair of elongated pivot arms having a scoop secured to one end of the pivot arm. The scoop includes spaced apart front and back walls, a bottom wall and a generally horizonal cutting edge which extends along one edge of the bottom wall between the front and back walls. The other ends of the pivot arms on one bucket half are pivotally secured to the pivot arms on the other bucket half so that the bucket halves are movable between an open position and a closed position. In the closed position, the open sides of the bucket halves register with each other to contain cargo within the interior of the bucket whereas, in their open position, the open ends and the digging edges of the bucket are spaced apart from each other. A head is disposed above the bucket halves and is secured to the bucket halves by cables which extend from the head and to each scoop. A closure cable is then secured to the bucket halves for moving the halves between their open and their closed position. Additionally, the length of the cables together with the connection point between the cables and the bucket halves are arranged so that the cutting edge moves substantially in a horizontal plane as the bucket halves are moved between their open and their closed position.

6 Claims, 2 Drawing Sheets

POWER BUCKET

CROSS REFERENCE TO RELATED APPLICATIONS

This application is a continuation-in-part of U.S. patent application Ser. No. 341,488, entitled POWER BUCKET, filed on April 20, 1989.

BACKGROUND OF THE INVENTION

I. Field of the Invention

The present invention relates generally to a power bucket for use with a power shovel for loading and unloading cargo.

II. Description of the Prior Art

The previously known clam shell buckets of the type for use with power shovels typically comprise a air of bucket halves which are pivotally secured adjacent their upper end. The upper end of the bucket is also known as the bucket head and this head is connected by a cable to a power mechanism which lowers and raises the bucket. Additionally, the power shovel includes a closure cable to move the bucket halves between their open and their closed position.

Because of the construction of the previously known clam shell buckets, the clam shell buckets dig downwardly into the load as the clam shell bucket is moved from its open and to its closed position. Such buckets are effective for unloading deep cargo containers, such as the cargo area for a freighter containing aggregate material like coal, iron ore, or the like.

While these previously known clam shell buckets have proven effective for unloading cargo from deep cargo containers, they have not proven wholly effective for removing only a relatively shallow portion of the load. For example, in the event of an environmental spill on the bottom of a river bed or the like, it is desirable to remove only the contaminated area of the river bed which may extend only several inches into the river bed. Consequently, when these previously known clam shell buckets are used to remove such environmental spills, the clam shell buckets remove not only the contaminated portion of the bed, but also a large portion of the uncontaminated soil beneath the lake bed.

All of the removed material, however, must be disposed of which is not only time consuming, but also very expensive.

SUMMARY OF THE PRESENT INVENTION

The present invention provides a bucket for a power shovel which overcomes all of the above mentioned disadvantages of the previously known devices.

In brief, the bucket of the present invention comprises a first bucket half and a second bucket half wherein each bucket half includes a pair of elongated pivot arms having a scoop secured to one end. The scoop has spaced apart front and back walls and a bottom wall which extends between the front and back walls so that one free edge of the bottom wall also forms the cutting edge or digging edge for the power shovel. An inside of each scoop is open.

The other ends of the pivot arms on one bucket half are pivotally secured to the pivot arms on the other bucket half so that the bucket halves are movable between an open and a closed position. In their open position, the scoops are spaced apart from each other and face generally downwardly towards the load. Conversely, in their closed position, the open insides of the scoop register with each other so that the cargo is contained within the interior of the bucket.

Unlike the previously known clam shell buckets, the head for the bucket of the present invention is not secured directly to the bucket halves. Instead, the head of the present invention is disposed above the bucket halves and is secured to the bucket halves by four cables. Two cables extend to the scoop on one bucket half while, similarly, the other two cables extend to the scoop on the other bucket half. These cables, which are much lighter than an integral metal construction knoWn to the previously known clam shell buckets effectively decreases the overall weight of the bucket for a given cargo carrying capability.

A closure cable also extends through the head and is secured around pulleys to both bucket halves. The closure cable, when retracted, first causes the bucket halves to move from their open position and to their closed position. Subsequent lifting of the closure cable lifts the closed bucket with its contained load in the conventional fashion.

The cables extending between the bucket and the head, as well as the point of connection between the cables and the scoop on each bucket half, are dimensioned so that the vertical distance between the head and the cutting edge remains substantially constant as the bucket is moved between its open and its closed position. Consequently, unlike the previously known clam shell buckets which dig down into the load as the bucket halves are closed, with the present invention, the cutting edge moves in substantially a horizontal plane as the bucket is moved between its open and closed position. Consequently, with the present invention, a relatively thin layer of material can be scraped from the load, such as a contaminated river bed, into the interior of the bucket as the bucket is moved from its open to its closed position.

Unlike the previously known buckets, the present invention comprises a welded steel construction. Such construction is much less expensive not only in fabrication costs but is also lighter in overall weight.

Consequently, a primary advantage of the present invention is that, since only a relatively thin layer of material is removed from the load, the contaminated portion of a river bed or the like can be effectively removed without removing excessive portions of uncontaminated areas of the river bed.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
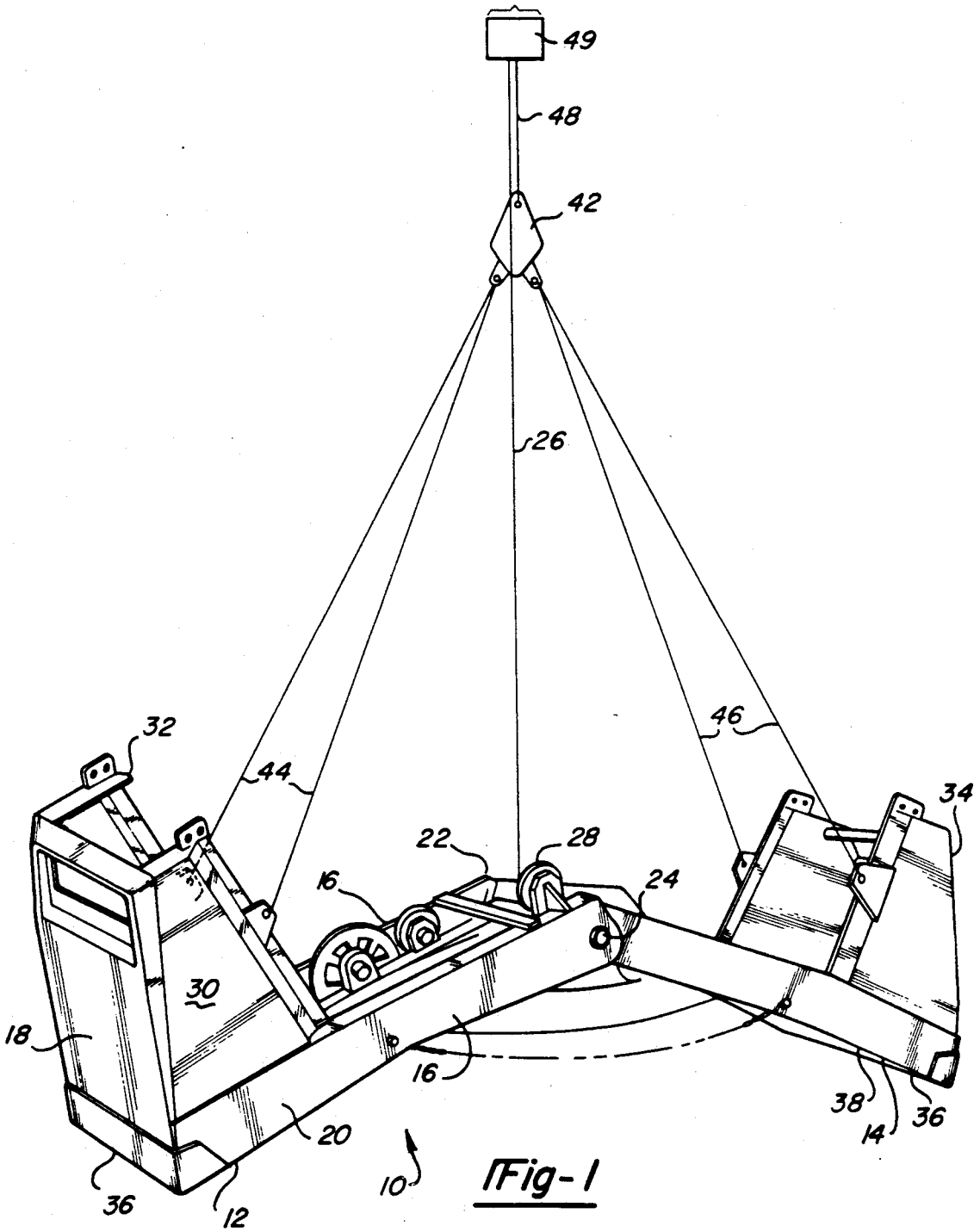
FIG. 1 is a perspective view illustrating the preferred embodiment of the present invention with the bucket in an open position.
Figure 2:
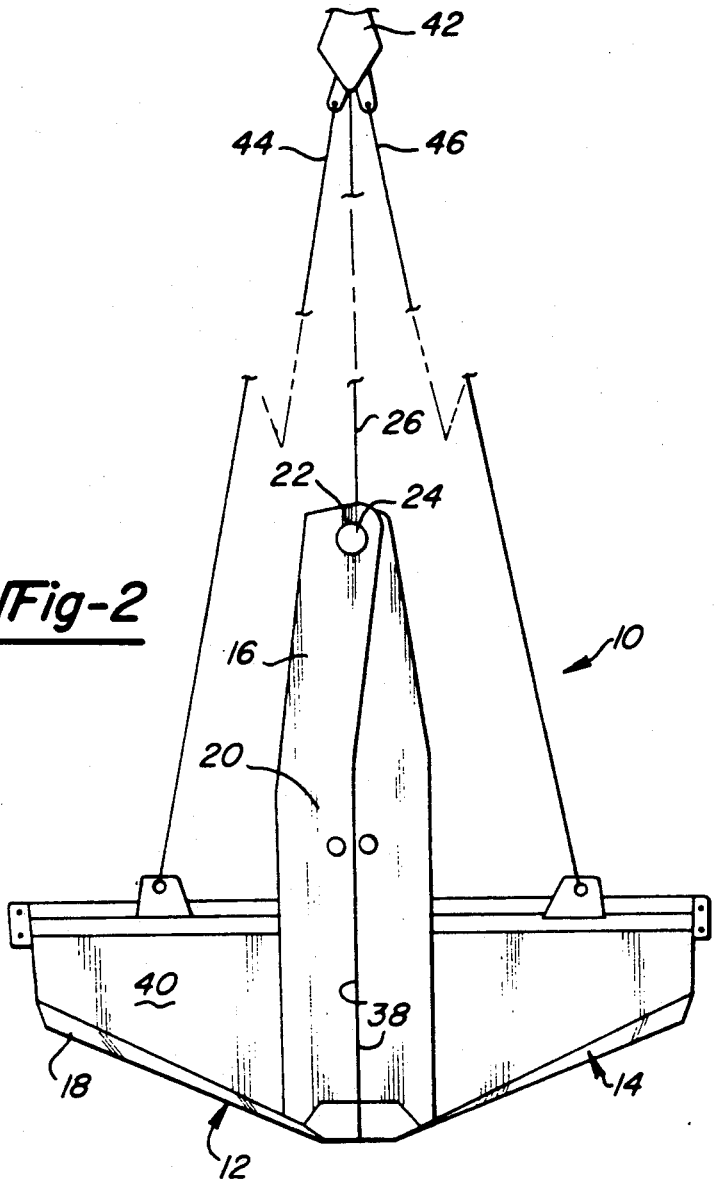
FIG. 2 is a view similar to FIG. 1 but illustrating the bucket in a closed position.

With reference first to FIGS. 1 and 2, a preferred embodiment of the bucket 10 for a power shovel is thereshown and comprises two bucket halves 12 and 14.

The bucket halves 12 and 14 are substantially identical to each other so that only one bucket half 12 will be described in detail, it being understood that a like description shall apply to the other bucket half 14 or 12.

The bucket halves 12 and 14 are constructed of a welded steel construction consisting of plates, supports, etc., which are welded together to form the bucket halves 12 and 14. This construction not only minimizes the cost and weight of the bucket 10 in comparison with previously know cast constructions, but also reduces the fabrication time necessary to construct the bucket 10.

The bucket half 12 includes a pair of spaced apart and parallel pivot arms 16 which are generally elongated. A scoop 18 is mounted to one end 20 of the pivot arms 16. The scoop 18 will be subsequently described in greater detail.

The other ends 22 of the pivot arms 16 are pivotally secured by a journal 24 to the corresponding pivot arms 16 on the bucket half 14. Consequently, the bucket halves 12 and 14 are pivotal between their open position, illustrated in FIG. 1, and their closed position, illustrated in FIG. 2.

A closure cable 26 is used to move the bucket halves 12 and 14 from their open and to their closed position The closure cable 26 operates in the conventional way and extends around one or more pulleys 28 mounted to the bucket halves 12 and 14. In the conventional fashion, one end of the closure cable 26 may be secured to one of the bucket halves 12 or 14 or, alternatively, extend upwardly from the power bucket 10 to a winch or a crane for increased lifting capability. The operation of the closure cable, together with the pulleys 28, is well known in the art so that a further description thereof is unnecessary.

With reference now to FIG. 1, the scoop 18 includes spaced apart front and back walls 30 and 32, respectively, and a bottom wall 34 which extends in between the front and back wall and along the bottom of the bucket when the bucket 10 is in its closed position. An edge 36 extending between the front and back wall 30 and 32 along one side of the bottom wall 34 forms the cutting or digging edge for the bucket 10. Additionally, an inside surface 38 of each scoop 18 is open.

With the bucket 10 in its open position, the inside surface 38 of each scoop 18 faces generally downwardly toward the load. Simultaneously, the cutting edges 36 of the scoop 18 on each bucket half 12 and 14 are spaced apart from each other. Conversely, when the bucket halves 12 and 14 are moved to their closed position (FIG. 2), the inside surfaces 38 of the bucket halves 12 and 14 register with each other and contain a load within an inside chamber 40 formed by the bucket halves 12 and 14.

With reference again to FIGS. 1 and 2, a head 42 is disposed above the bucket halves 12 and 14 directly above the journal 24 which pivotally connects the bucket halves 12 and 14 together. Two cables 44 extend between the head 42 and the scoop 18 on one bucket half 12 while, similarly, two other cables 46 extend between the head 42 and the scoop 18 on the second bucket half 14. These cables 44 and 46 are preferably constructed of steel and serve to support the bucket halves 12 and 14 from the head 42. The head 42, in turn, is connected by a cable 48 to a power winch 49 on the power shovel.

Figure 3:
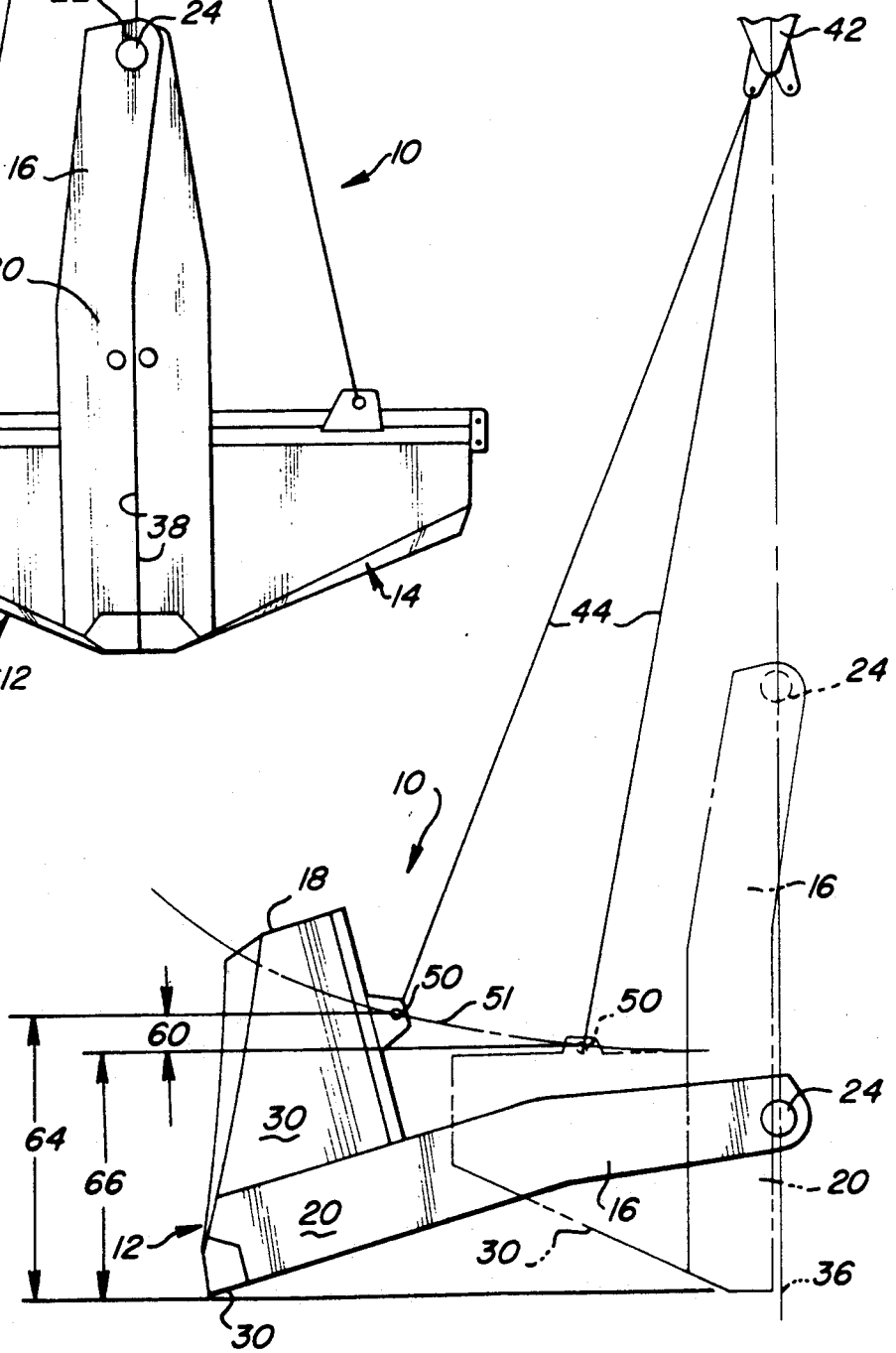
FIG. 3 is a diagrammatic view illustrating the operation of the present invention.

With reference now particularly to FIG. 3, the cables 44, together with their connection point 50 with the scoop 18 on the bucket half 12, are dimensioned so that the vertical distance between the head 42 and the cutting edge 36 remains substantially constant as the bucket half 12 is moved from its open and to its closed position. Consequently, the cutting edge 36 of the bucket moves in substantially a horizontal plane as the bucket moves between its open and closed position and the same occurs for the other bucket half 14. This in turn allows only a thin layer of the load to be scraped or removed from the load.

Still referring to FIG. 3, the length of the cables, size of the bucket halves and the connection points 50 between the cables 44 and 46 and their respective scoops 18 will vary from one bucket to the next. However, as is clear from FIG. 3, as the bucket half 12 moves from its open to its closed position, the cables 44 swing downwardly in an arc 51 thus increasing the vertical distance between the head 42 and the connection points 50 by a distance 60.

Simultaneously as the bucket is closed, however, the vertical distance between the connection point 50 and the cutting edge 36 of the scoop 18 decreases from a distance 64 to a distance 66 by an amount substantially the same as the distance 60. The decrease in the vertical spacing between the connection point 50 and the cutting edge 36 as the scoop is closed results from the pivotal action of the bucket halves as the bucket halves 12 and 14 pivot approximately 90 degrees from their open to their closed position. In doing so, the horizontal distance between the connection point 50 and the cutting edge 36 (when open) becomes the vertical distance between the connection point and the cutting edge 36 (when closed). Consequently, the length of the cables 44 and 46 and their connection point 50 with the bucket halves are arranged so that, with the bucket open, the vertical distance minus the horizontal distance between the connection point 50 and the cutting edge 36 (when open) is substantially equal to the increase in vertical distance between the connection point 50 and the head 42 resulting from the swinging arc of the cables 44 and 46 as the bucket moves from its open to its closed position.

Consequently, the cutting edge 36 moves substantially in a horizontal plane as the bucket halves 12 and 14 are moved between their open and their closed position. Therefore, it can be seen that the present invention provides an improved bucket for power shovels which is particularly suited for removing relatively shallow depths of a load. This is particularly advantageous for removing contaminated lake and river beds.

Having described my invention, however, many modifications thereto will become apparent to those skilled in the art to which it pertains without deviation from the spirit of the invention as defined by the scope of the appended claims.

I claim:

1. A cargo bucket comprising:

a first and second bucket half, each bucket half having a pair of spaced pivot arms, a scoop secured to one end of each pair of said pivot arms, each of said scoops having a front wall, a back wall, a bottom wall, and a generally horizontal cutting edge extending along one edge of said bottom wall between said front and back walls, each said bucket half having an open inside, means for pivotally securing the other ends of said pairs of pivot arms together about a common pivot axis so that said bucket halves are movable about said means pivoting between an open position and a closed position, wherein in said closed position said open ends register with each other to contain cargo within an interior of the bucket and wherein in said open position said open ends of said bucket halves are spaced apart from each other so that said open inside of said bucket halves face generally downwardly, a head, a first pair of cables, said first pair of cables being secured at one end to said head and being secured at a connection point at their other ends to one bucket half at a position spaced from said pivotal securing means, a second pair of cables, said second pair of cables being secured at one end to said head and being secured at a connection point at their other ends to the other bucket half at a position spaced from said pivotal securing means, means including a cable and pulley connecting said bucket halves together at said scoops for pivotally moving said bucket halves from said open to said closed position, and wherein said cables are dimensioned in conjunction with their connection point with said bucket halves so that said cutting edge moves in a substantially horizontal plane as said bucket is moved between said open and said closed positions while said head remains in a substantially constant vertical position.

2. The invention as defined in claim 1 wherein said pivot arms are elongated.

3. The invention as defined in claim 1 wherein said cables are connected to a midpoint of said front and back walls of each said bucket half.

4. The invention as defined in claim 1 wherein each bucket half is of a welded steel construction.

5. The invention as defined in claim 1 wherein said pivotal securing means comprises a cylindrical tube extending through registering openings on said bucket halves.

6. The invention as defined in claim 1 wherein said pivotally moving means comprises a closure cable, said closure cable extends through said head, around a pulley on one bucket half and secured to the other bucket half.

* * * * *